US006238299B1

(12) United States Patent
Barnette

(10) Patent No.: US 6,238,299 B1
(45) Date of Patent: May 29, 2001

(54) GOLF CLUB SWING BAFFLE AND METHOD OF ATTACHING TO SHAFT

(76) Inventor: Robert W. Barnette, 104 Riverside Dr., Troy, OH (US) 45373

( * ) Notice: Subject to any disclaimer, the term of this patent is extended or adjusted under 35 U.S.C. 154(b) by 0 days.

(21) Appl. No.: 09/384,550

(22) Filed: Aug. 27, 1999

Related U.S. Application Data

(60) Provisional application No. 60/116,802, filed on Jan. 21, 1999.

(51) Int. Cl.[7] ..... A63B 69/36
(52) U.S. Cl. ..... 473/228
(58) Field of Search ..... 473/226, 228, 473/231, 233, 256

(56) References Cited

U.S. PATENT DOCUMENTS 3,565,444 * 2/1971 La Rocca ..... 473/228
3,809,397 * 5/1974 Gruenewald ..... 473/228
5,184,825 2/1993 Ruth .
5,310,188 5/1994 Hernberg .
5,395,107 * 3/1995 De Pippo ..... 473/228
5,415,406 5/1995 Reichenbach et al. .
5,571,048 * 11/1996 Kenney ..... 473/228

* cited by examiner

*Primary Examiner*—Steven Wong
(74) *Attorney, Agent, or Firm*—William Weigl

(57) ABSTRACT

A one-piece plastic molded baffle has a plurality of vanes extending lengthwise of a shaft to which it is to be attached. A central hub has a lengthwise opening therethrough and a slot communicating the opening to the exterior of the hub between two adjacent vanes. A pair of baffles diametrically opposite the slot are squeezed together with one hand to expand the slot and thereby enable the baffle to be easily placed on or removed from the shaft of a golf club. The material of which the baffle is made has high memory retention, allowing the opening to be sized to firmly fit all standard shaft diameters.

10 Claims, 2 Drawing Sheets

GOLF CLUB SWING BAFFLE AND METHOD OF ATTACHING TO SHAFT

This application is based in part upon my U.S. Provisional Patent Application Ser. No. 60/116802 filed Jan. 21, 1999.

This invention relates generally to a golf swing practice device for warm-up and muscle memory prior to playing a game of golf, and is useful also for training one's self to develop a grooved swing pattern and to build up golf swing related muscles. It further relates to a novel and simple method of attaching the swing baffle to the shaft of a golf club.

BACKGROUND OF THE INVENTION

Numerous types of golf club swing baffles are disclosed in the prior art for the purposes noted above. Several require fasteners to attach and detach the baffle, some are snap-on types of units, while some others fail to disclose how they are connected and disconnected, leaving one to assume the latter may be permanently installed on a club and are dedicated to only the practice mode of use. Some units are intended to be loosely connected to the shaft, some tightly held thereonto and at least one is said to be frictionally held on the shaft but is capable of rotation if an improper swing is made. Obviously, the baffle of the last-mentioned arrangement can only fit one manufacturer's shaft diameter and taper or others that are identical in diameter and taper. The large differences in shaft diameters and taper from one manufacturer to the next make the arrangement appear of questionable value, particularly since its inventor fails to indicate how one can distinguish a bad swing from a good swing.

SUMMARY OF THE INVENTION

A one-piece plastic molded baffle has a plurality of vanes extending lengthwise of a shaft to which it is to be attached. A central hub has a lengthwise opening therethrough and a slot communicating the opening to the exterior of the hub between two adjacent vanes. A pair of baffles diametrically opposite the slot are squeezed together with one hand to expand the slot and thereby enable the baffle to be easily placed onto or removed from the shaft of a golf club. The material of which the baffle is made has high memory retention, allowing the opening to be sized to firmly grip all standard shaft diameters.

A principal object of the invention is to provide a one-piece golf club swing baffle capable of being easily installed and removed relative to a golf club shaft, without the use of tools or independent attaching elements.

Another object is to provide a novel method of applying the foregoing baffle to a golf club shaft, utilizing only the fingers and heel of one hand to manipulate the baffle.

Still another object is to provide a baffle of a size and shape readily carried in a conventional golf club bag during play of the game of golf.

Another object is to provide a baffle that is symmetrical from one end to the other and therefore make it easily injection-moldable and universally usable by either a right or left-handed golfer.

Other objects and advantages will become apparent from the following description, in which reference is made to the accompanying drawings.

DESCRIPTION OF THE PREFERRED EMBODIMENTS

Figure 1:
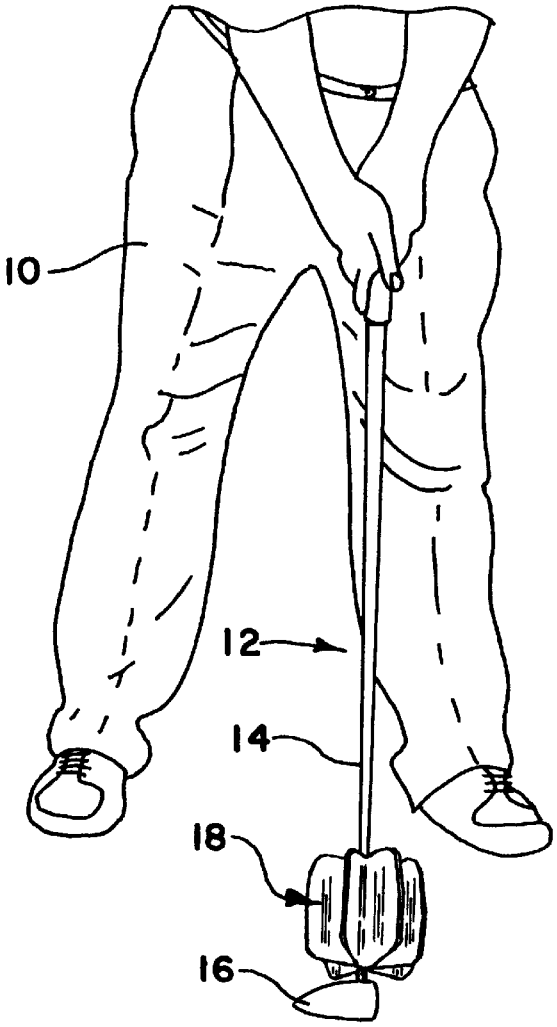
FIG. 1 is a frontal lower-body view of a golfer in the "ball address" position, with a golf club having a shaft carrying the baffle of my invention.
Figure 2:
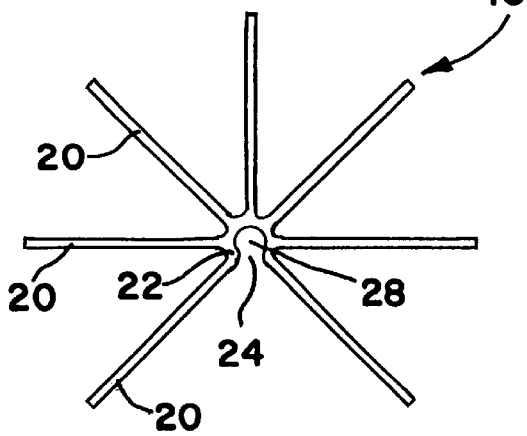
FIG. 2. is an end view of the baffle, the opposite end of which is a mirror image of FIG. 2.

A golfer 10 is shown in FIG. 1 gripping a standard club 12 having a shaft 14 and a clubhead 16. A wind-resisting baffle 18 is removably secured to the lower end of the shaft 14. In FIG. 2, a plurality of vanes 20 are shown to extend radially outward from a central hub 22, encompassing more than 270 degrees of the shaft. A slot 24 extends the full length of the baffle 18 and hub 22, providing for lateral ingress and egress of the shaft 14 relative to the baffle 18. Since golf club swing baffles and their intended purposes are generally well known in the art, there is little need to elaborate on that here.

Figure 3:
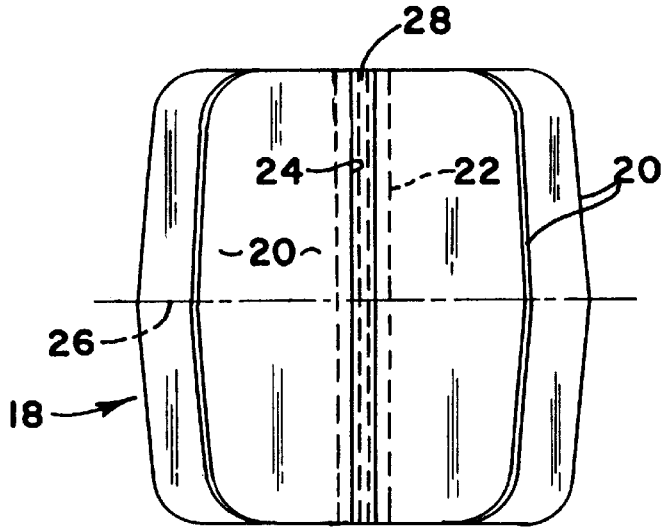
FIG. 3 is a side view of the baffle, taken looking essentially toward FIG. 2 in the upward direction.

It can be seen in FIG. 3 that the baffle 18 is symmetrical from a center plane 26 toward each end. This not only makes for simple injection molding as a single piece, but it also provides for universality of use by either a right or left handed golfer. The plastic of which the baffle 18 is molded should be one with high memory retention, long life in holding its original shape and one which retains its shape and flexibility in a wide range of temperatures. One such plastic found to be suitable is a high impact polypropylene homopolymer. The length and girth dimensions of a suitable design are five inches and four and one half inches, respectively. The girth should be of a size which produces effective wind resistance during use, but should also be small enough to permit the baffle to be carried in practically any golf bag pocket. The shape of vanes 20 are such as to provide substantial wind resistance for their lengths from end to end. The suitable carrying size is of value in instances where the golfer who is about to play a game can take the baffle to the first tee, warm up there and can keep it with him or her throughout the game for added use if desired. Some large baffles presently on the market are incapable of being carried on the golf course, and would require warm-up either at one's vehicle or returning it to the vehicle prior to starting a round of golf. The vanes 20 and central hub 22 are tapered from the plane 26 of FIG. 3 toward the ends to enable easy removal of the finished product from the mold. An inherent characteristic of injection molding is some minute element of warpage and shrinkage at the ends remote from the plane 26. This suits my design nicely, since it causes walls surrounding an opening 28 in the hub 22 to grip the shaft 14 with slightly greater force at the ends of the baffle than at the center. There are a large number of shapes and shaft diameters which must be accommodated in order to have a practical design which fits practically all shafts. Some shafts are tapered, some parallel at the clubhead or tip end and some tapered with steps between successive sections. Where the shafts are tapered or stepped, I have found that the flexibility of the baffle causes more secure gripping at the larger diameter portion of the shaft, even though the central hub 22 extends the length of the baffle. On some occasions, I have found that the shaft gripping is tight at both ends of the hub 22, while being free enough at the middle to slip a corner of a thin sheet of paper into the slot 24 between the shaft 14 and the inside walls of the hub 22. The dimensions will be mentioned in connection with FIG. 6, and I have found these dimensions to fit all shafts except for one recent shaft design known as the "Fat Shaft".

Figure 4:
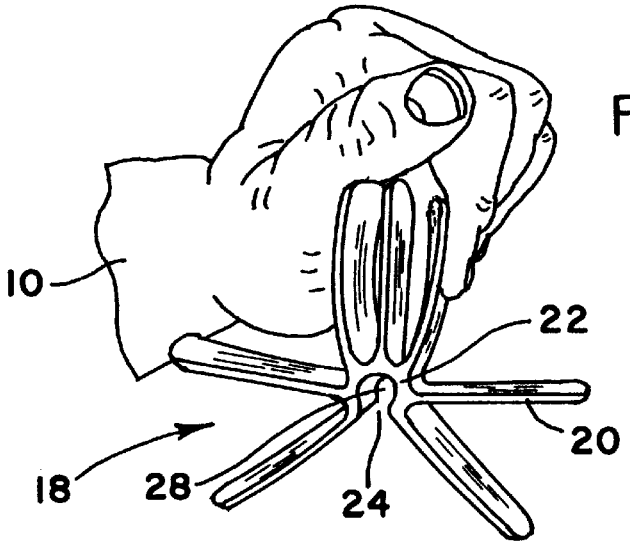
FIG. 4 is an end view of the flexible baffle with two of it vanes being hand-squeezed toward each other to spread the slot opposite the two squeezed vanes and thereby enable easier placement of the baffle onto or removal from a golf club shaft.
Figure 5:
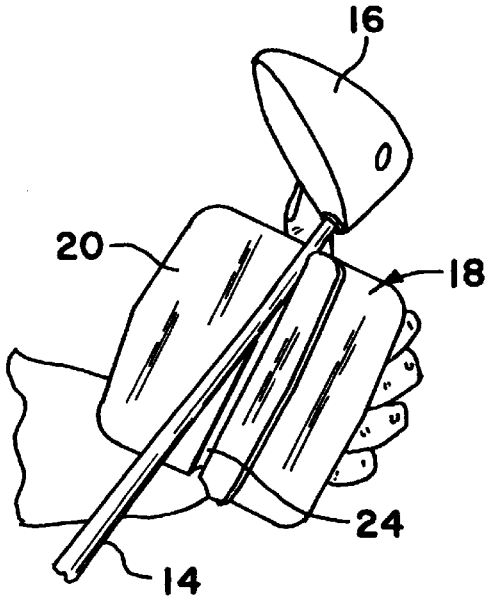
FIG. 5 illustrates the physical placement of the baffle onto a shaft with one hand while the club is being steadied.
Figure 6:
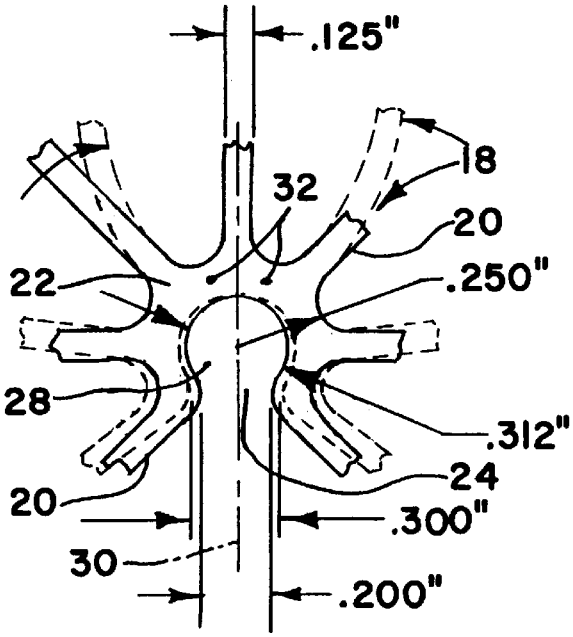
FIG. 6 is an enlarged fragmentary end view of the baffle hub and slot showing the relaxed condition of the vanes and slot in solid lines and the squeezed condition of FIG. 4 in dotted lines.

In the process of designing my baffle, I have discovered a rather unique method of applying it to and removing it from a shaft. This method is depicted in FIGS. 4 and 5. With the fingers and heel of one hand, the golfer may squeeze two of the vanes 20 which are spaced essentially equal amounts on opposite sides of a plane 30 (FIG. 6). This enlarges the slot 24 and center of the opening 28, expanding the slot width and enabling its and the opening's passage over the shaft. Then, when the hand grip is relaxed, the memory of the plastic returns it toward its original condition and causes the hub internal walls to affix the baffle to the shaft. While this is taking place, the club may be held in the golfer's other hand or between his knees or thighs to steady the club. FIG. 5 shows the starting of the placement of one end of the baffle at the thinnest end of the shaft 14, after which it can be rotated to snap the entire slot over the shaft while continuing to squeeze the two vanes together. When removal of the baffle is desired, the same squeezing motion as in FIG. 4 may be done while holding the shaft with the other hand directly next to the baffle. This allows the thumb of the hand holding the shaft to be pressed against a vane adjacent the slot 24 to remove the thumb-contacted end of the baffle first, reversing the installation rotation of FIG. 5.

FIG. 6 shows the dimensions of the various parts of the baffle that I have found to be quite suitable to perform the preferred method. It further shows the elements of the baffle 18 in a relaxed condition (removed from a shaft) in solid lines, and the condition those same elements assume when vane squeezing takes place as in FIG. 4, whether the baffle is being applied to or removed from a shaft 14. The two vanes at are shown to be squeezed are, as stated earlier, on opposite sides of the plane 30 passing through the slot 24 and opening 28 (FIG. 6). In my preferred design, there is another vane 20 midway between two squeezed vanes. The squeezing appears to treat the two points 32 as a fulcrum or fulcrums relative to the intervening vane, with the hub portions from each point 32 to the nearest edge of the slot 24 acting as pivotal levers. Whether or not the intervening vane or its equivalent thickening of the hub at the fulcrum point is required is not known at the present time, but it appears to be beneficial. In effect, the leverage of moving the vanes toward each other as in FIG. 4 causes a hinging action about the fulcrums and a corresponding expansion of the slot 24. This totally eliminates the need for any fasteners or tools in attaching or detaching the baffle to a shaft.

Ideally, the vanes 20 should be uniformly spaced at equal angles about 360 degrees of the baffle. No vane is provided on one side because of the existence of the slot 24. This has been found not to be detrimental, however. Even without uniform vane spacing, the baffle can still be placed at any angle relative to the shaft without adverse wind resistance characteristics. The vanes 20 require no particular relation to the club face since a plurality of vanes are employed in the baffle. Furthermore, I have found it unnecessary to place the slot 24 opposite the club face during use on a club because of the baffle opening dimension which provides the tight grip on all shafts. The opening 28 is preferably 0.325 inches with a few thousandths of an inch tolerance either way. Most golf club shafts at the tip end are in the range of 0.330 to 0.370 inches with variances occasioned by being either evenly tapered or step tapered. The dimensions in FIG. 6 are illustrative only, as is the actual shape and sizes of the vanes.

Various other changes may be made without departing from the spirit and scope of the claims. The relatively slim design from end-to-end, while being desirable for bag-carrying purposes, is not critical. Different girth and/or length baffles may be made for males and females and for youngsters or senior golfers. So also, the number and shape of the vanes may be different from what is shown.

Having described my invention, I claim:

1. A one-piece plastic baffle adapted to be removably laterally mounted on the end of the shaft of a golf club adjacent the clubhead by a person installing or removing the baffle, said baffle offering air resistance during practice swinging of the club in a swing by a golfer, said baffle comprising:

a tubular central hub having a flexible body portion and a generally cylindrical opening therethrough for the entire length thereof;

said hub having a lengthwise slot radially communicating said hub opening with the hub exterior for its entire length, the diameter of said hub opening being slightly smaller than the diameter of said shaft whereby the hub will frictionally grip the shaft when placed laterally thereon and the width of the slot being less than the shaft diameter;

a plurality of vanes extending parallel to and radially from the hub for essentially the length thereof, said vanes extending circumferentially and generally equidistantly around the hub from adjacent each side of the slot;

the relative thicknesses of the vanes and the flexible body portion of the central hub being such that circumferential movement of said vanes toward and away from each other causes said flexible body portion to open and close the slot and cylindrical opening respectively;

one pair of said vanes being physically squeezable toward each other to enable expansion of said slot for installation of said baffle on a shaft, said one pair including vanes located on the side of said hub diametrically opposite said slot and being spaced apart angularly approximately the distance between the finger tips and heel of the installer's hand, one on each side of a plane passing through said slot and said opening; and a fulcrum point at said hub intermediate said one pair of vanes, whereby said one pair of vanes, when squeezed toward each other, causes the flexible body portion of the hub to expand said slot and facilitate ingress or egress of the shaft relative to said hub opening.

2. The baffle of claim 1 wherein the angle between said pair of vanes is on the order of ninety degrees.

3. The baffle of claim 2 wherein the vanes extend equal radial distances from said hub and wherein said baffle has an outside diameter between four and six inches.

4. The baffle of claim 3 wherein the hub is tapered both internally and externally from the middle toward each end.

5. The baffle of claim 1 wherein the diameter of the central opening is approximately on the order of 0.325 inches.

6. The method of temporarily attaching an air-resistance baffle to the clubhead end of the shaft of a golf club whereby practice swinging of the club through a swing plane requires expending of additional energy after the baffle has been attached as compared to the amount of energy required to swing the club without the baffle attached, said method comprising the steps of:

providing a unitary, molded, flexible, high memory retention plastic baffle having a longitudinal central hub with an axial hole therethrough of a diameter slightly less than the diameter of the shaft adjacent the clubhead end and further having a slot narrower than the hole diameter and extending the length of the central hub whereby said baffle may be laterally placed onto said shaft by expanding the slot to enable the hole and shaft to be aligned with the hub encompassing in excess of 270 degrees of said shaft, said baffle having a plurality of circumferentially-spaced vanes each of which extends radially and longitudinally of said central hub and at least two of which vanes are spaced apart approximately forty-five degrees on opposite sides of a plane passing through the hole axis and the center of said slot;

placing the baffle with its slot being adjacent the clubhead end of the shaft in essentially parallel relationship in preparation for attaching the baffle thereto;

steadying the shaft to receive the baffle;

gripping the distal ends of said two vanes between the fingers and heel of one hand;

expanding the slot sufficiently to enable lateral passing of the slot beyond the shaft's axis by hand-pressing the two vanes in a circumferential direction toward each other about a fulcrum area where said two vanes merge with said hub to flex the slot edges outwardly;

placing the baffle on the shaft; and relaxing the hand grip on said vanes so that memory retention of the plastic restores said hub toward its original condition and thereby enables the hub to firmly affix the baffle to the shaft.

7. The method of claim 6 wherein the placing of the baffle on the shaft is initially accomplished by passing one end of the slot over the shaft and progressively rotating the slot toward the shaft until the entire baffle is in place.

8. The method of claim 7 wherein the initial placing proceeds at the end of the shaft nearest the clubhead.

9. The baffle of claim 1 wherein the internal dimensions of said cylindrical opening in said hub and the diameter of the shaft are so related that the frictional grip between the baffle and shaft is of sufficient greatness whereby to inhibit relative rotation of the baffle about the shaft during practice swinging of the club, said baffle being functional to offer air resistance to a swing irrespective of the angular position of the baffle about the shaft.

10. The baffle of claim 1 wherein the length of said tubular central hub is approximately twice the depth of a clubhead.

* * * * *